United States Patent [19]

Wallace

[11] 4,043,277

[45] Aug. 23, 1977

[54] FOLDABLE STOOL

[75] Inventor: Doralee A. Wallace, Hollis, N.Y.

[73] Assignee: The Raymond Lee Organization, Inc., New York, N.Y. ; a part interest

[21] Appl. No.: 676,313

[22] Filed: Apr. 12, 1976

[51] Int. Cl.[2] ..... A47B 3/00

[52] U.S. Cl. ..... 108/35; 248/188.5; 403/106

[58] Field of Search ..... 108/35; 248/407, 188.5, 248/411; 403/106, 83, 109, 348; 24/230 TC; 292/153, 274, 267, 270

[56] References Cited

U.S. PATENT DOCUMENTS

| | | | |
|---|---|---|---|
| 564,711 | 7/1896 | O'Brien | 108/35 |
| 2,451,763 | 10/1948 | Misko | 108/35 |
| 2,934,386 | 4/1960 | Shore | 108/35 |

FOREIGN PATENT DOCUMENTS

| | | | |
|---|---|---|---|
| 640,937 | 8/1950 | United Kingdom | 108/35 |
| 744,192 | 2/1956 | United Kingdom | 108/35 |

*Primary Examiner*—Roy D. Frazier
*Assistant Examiner*—Peter A. Aschenbrenner
*Attorney, Agent, or Firm*—Howard I. Podell

[57] ABSTRACT

A lightweight foldable stool formed with a top that is hinged along a mid-line and hinged on its underside to telescopic legs.

2 Claims, 4 Drawing Figures

FOLDABLE STOOL

SUMMARY OF THE INVENTION

My invention is a lightweight foldable stool formed with a top that is hinged along a mid-line and hinged on its underside to telescopic legs.

My stool is preferably formed with a circular top section that may be folded for storage and is made of a size that may be carried on the person or in a bag so that the user may sit on the stool while waiting for a transit connection or at other times.

BRIEF DESCRIPTION OF THE DRAWINGS:

The objects and features of the invention may be understood with reference to the following detailed description of an illustrative embodiment of the invention, taken together with the accompanying drawings in which.

Figure 1:
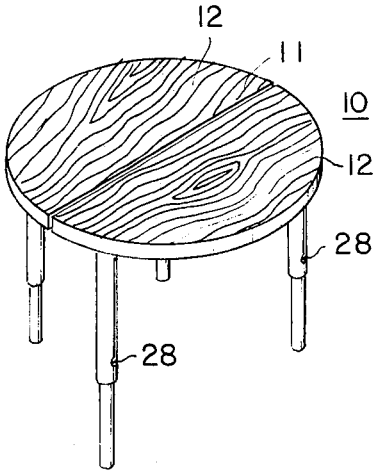
FIG. 1 is a perspective view of the stool in the extended position.
Figure 2:
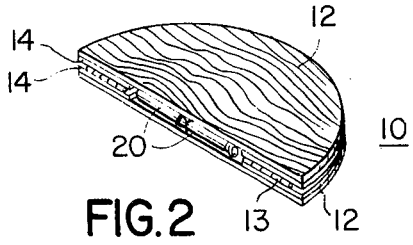
FIG. 2 is a perspective view of the stool in the folded position.
Figure 3:
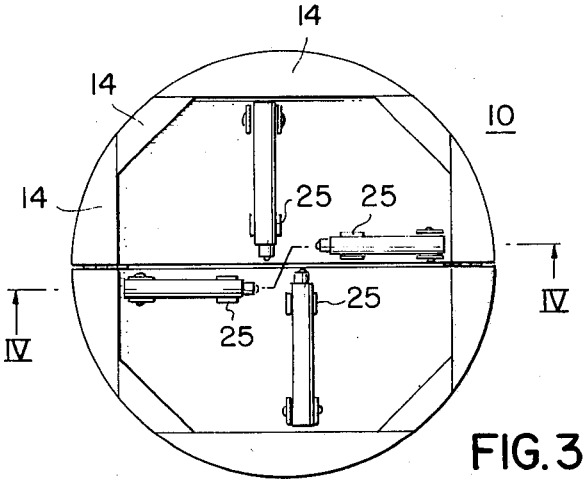
FIG. 3 is a bottom plan view of the stool.
Figure 4:
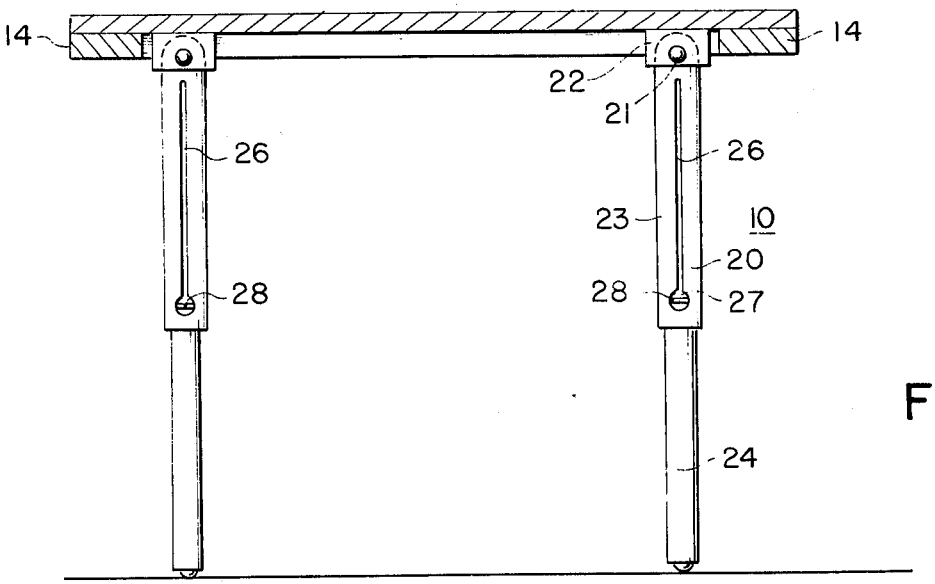
FIG. 4 is a sectional view taken along line IV—IV of FIG. 3.

DESCRIPTION OF THE PREFERRED EMBODIMENT:

Turning now descriptively to the drawings, in which similar reference characters denote similar elements throughout the several views, FIGS. 1-4 illustrate the foldable stool 10 which is formed of a circular top unit 11 formed of two half sections 12 joined together by a pair of hinges 13 that permit the two half sections 11 to fold into parallel planes as shown in FIG. 2.

The underside of the rim of each semi-circular top half section 11 is fitted with a continuous spacer block 14 of half the thickness of the legs 20 hinged by pins 21 to brackets 22 mounted on the underside of sections 11.

Each leg 20 is formed of two telescopic sections 23 and 24 and the leg brackets 22 are oriented so that in the folded position of the legs 20, the top half section 12 of the stool may be folded together, with the folded legs 20 nested without touching each other and with the spacer block 14 of the rim concealing the legs 20, about the circular perimeter of the half section 12.

The outer leg unit 23 is formed with a longitudinal through slot 26 in which a rotatable key 28, which is pinned to the inner leg unit 24, rides. The lower end of slot 23 is formed with an enlarged section 27 in which the head of key 28 may be rotated to lock the leg units 23 and 24 in the extended position, with rotation of key 28 enabling key 28 to slide in slot 26 when the leg units are telescoped together. Clips 25 on the underside of sections 11 hold the telescoped legs 20 folded to the panel section 11. Bracket 20 may be fitted with means to hold the extended legs in a fixed position perpendicular to the plane of panels 11.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A foldable stool formed with a platform of two panel members hinged together, with a plurality of telescopic legs hinged to the underside of the panels, the underside of said panels each fitted with spacer blocks along the outer edges of the panels for concealing the folded legs when the panels are folded together, with each telescopic leg formed of an inner member slidably mounted in a hollow outer member, said outer member formed with a through longitudinal slot extending for a portion of the length of said member in which slot rides the head of a key that is pivotally fixed to the said inner member, said slot formed with an enlarged section of a size to accommodate the head of the key in a first position of rotation of said key, with the remainder of the slot of lesser width so as to block movement of the key in said first position, and in the enlarged section of the slot, from travelling in said remainder of the slot, so as to latch the attached inner and outer members together when the key head is rotated to said first position in said enlarged section of the slot, said key mounted in said inner section so as to project into the enlarged section of the slot of the outer section in the extended position of the legs.

2. The combination as recited in claim 1, in which the outer member is hinged at its upper end to the underside of a panel and the enlarged section of the slot is at the lower end of the slot.

* * * * *